United States Patent [19]

Bessen

[11] 3,957,454

[45] May 18, 1976

[54] COATED ARTICLE

[75] Inventor: Irwin I. Bessen, Cincinnati, Ohio

[73] Assignee: General Electric Company, Cincinnati, Ohio

[22] Filed: Nov. 15, 1974

[21] Appl. No.: 524,328

Related U.S. Application Data

[62] Division of Ser. No. 353,764, April 23, 1973.

[52] U.S. Cl. ..... 29/194; 29/197

[51] Int. Cl.[2] ..... B32B 15/00

[58] Field of Search ..... 29/194, 197

[56] References Cited

UNITED STATES PATENTS

| | | | |
|---|---|---|---|
| 3,290,126 | 12/1966 | Monson | 29/194 |
| 3,542,530 | 11/1970 | Talboom et al. | 29/194 X |
| 3,594,219 | 7/1971 | Maxwell et al. | 117/131 |
| 3,649,225 | 3/1972 | Simmons | 29/194 |

*Primary Examiner*—L. Dewayne Rutledge
*Assistant Examiner*—E. L. Weise
*Attorney, Agent, or Firm*—Lee H. Sachs; Derek P. Lawrence

[57] ABSTRACT

An article is provided with improved resistance to hot corrosion through a coating on a metal surface based on an element selected from Fe, Co and Ni, the coating comprising a filled matrix bonded by interdiffusion with the substrate. The matrix is applied by impinging on the substrate metal surface a plurality of heated metallic particles, such as by plasma spraying. The coating includes a filler metal of aluminum and preferably an alloy of aluminum and at least one other element, for example Cr, deposited on and interdiffused with the matrix, such as through a halide vapor deposition process employing a mixture of aluminum powder and other powders. As a result of application of the filler metal, there is provided from the matrix a coating layer of an alloy including an average of about 8 – 20 weight percent aluminum, the application process resulting in substantial recrystallization of the matrix.

4 Claims, 8 Drawing Figures

COATED ARTICLE

This is a division of application Ser. No. 353,764, filed Apr. 23, 1973.

BACKGROUND OF THE INVENTION

This invention relates to coatings which provide an article with improved hot corrosion resistance and, more particularly, to a coating for use in connection with a Fe, Co or Ni based substrate and comprised of a coating matrix interdiffusion with an aluminum filler. The invention herein described was made in the course of or under a contract, or a subcontract thereunder, with the U.S. Dept. of the Air Force.

Components of certain energy conversion apparatus, such as gas turbine engines, operating in an oxidizing atmosphere in the temperature range of about 1300° – 1800°F, have suffered degradation from environmental exposure. A principal mode of attack is hot corrosion. It can occur when ingested airborne salt, particularly in marine environs, combines with fuel sulfur. Sodium sulfate can form as a condensate on apparatus parts such as in the turbine and can aggressively attach component alloys or their coatings.

Modern turbine engines are constructed of superalloys based on the transition triad elements Fe, Co and Ni and alloyed to have some inherent resistance to corrosion. However, to extend the life of such alloys, protective coatings have been used. One such class of coatings is the aluminides. These generally are formed by a high temperature interdiffusion reaction at the interface between aluminum, applied in some form, and of the superalloy substrate. A variety of coating processes involving such reaction have been widely reported and are commercially available. Another class of reported coatings is the MCrAlY vapor coatings in which M is the base metal element. These are alloys of Fe, Co or Ni base alloyed with Cr, Al and Y are deposited by vacuum vapor condensation on a substrate surface. Such vapor coatings have been shown to have certain advantages in providing extended life to articles such as turbine parts. However, they are relatively costly to produce and require relatively expensive manufacturing equipment.

An additional requirement of such coatings is that they do not degrade the superalloy properties either through process effects or physical surface effects. In this regard, soft, ductile coatings are preferred to hard, brittle coatings because they yield more to rapid thermal cycling of the type found in a turbine. Furthermore, they are not prone to surface cracking and stress concentrations which can degrade fatigue properties.

SUMMARY OF THE INVENTION

It is a principal object of the present invention to provide a superalloy substrate with a coating integrally bonded with the substrate and having improved hot corrosion resistance along with ductility, thus to provide an article having a useful life greater than one including known coatings.

A more specific object is the provision of a gas turbine engine article coated with an MCr-base type of coating or its modifications in combination with aluminum or its alloys for enhanced hot corrosion and ductility.

A further object is to provide, in the application of such coating, an economic process, including use of a novel metallic powder mixture, that does not require use of the relatively expensive vacuum vapor apparatus.

Another object is to provide a method for applying such coating to the exterior of an article including a hollow interior or hollow passageways within the article and coating the hollow interior with an aluminide coating simultaneously with the coating of the exterior.

These and other objects and advantages will be more clearly understood from the following detailed description, the examples and the drawings all of which are intended to be representative of rather than limiting in any way on the scope of the present invention.

Briefly, the above objects are attained through a method which impinges heated MCr-base alloy particles on the surface of the article such as through plasma spraying. Such particles, upon contact with the surface or with other applied particles, deform plastically, fuse and cool to deposit on and bond to the surface a fused coating matrix which includes voids, lattice vacancies and possibly entrapped oxides. Because of such impact and cooling, there is deformation retained in such structure. Then there is diffused into such matrix, through its outer surface, a filler metal of aluminum or an alloy of aluminum deposited from a halide vapor produced from aluminum powder or a mixture of a powder of aluminum or of an alloy including aluminum and a powder of at least one other element which either changes the solubility of the substrate for Al or forms a stable Al compound or both. This is conducted in a manner not only to fill the voids but also to recrystallize the matrix thereby producing a dense, ductile coating layer including an aluminum content in the average range of about 8 – 20 weight percent aluminum.

The coated article with which the present invention is concerned includes, on its substrate of an alloy based on Fe, Co or Ni, a coating which comprises a deformed and predominantly recrystallized coating metallurgically bonded by interdiffusion with the substrate. In its finished form, the coating comprises a plurality of fused and forged particles of an alloy based on Fe, Co or Ni and an aluminum or aluminum alloy filler interdiffused with the matrix to provide an alloy of about 8 – 20 weight percent Al with the balance elements of the base, of the substrate and of any other element alloyed with aluminum in the filler metal. There can be interspersed between the fused particles non-metallic materials such as oxides or compounds of Al, Cr, Y or the rare earths elements.

DESCRIPTION OF THE PREFERRED EMBODIMENTS

The method contemplated in connection with this invention includes two basic steps: matrix deposition from heated metallic particles, such as through plasma spraying; and a critical diffusion coating and recrystallization process with aluminum or an aluminum alloy. These two basic steps are preceded by surface preparation.

The surface preparation may vary in nature. It is intended to provide a clean substrate suitable for the adherence of the matrix such as by plasma spraying. One acceptable form of surface preparation is the standard and relatively widely used technique of grit blasting prior to such matrix application.

The preferred form of matrix application is through plasma spraying of the type used commercially and for which commercial apparatus is readily available. The plasma spraying applies a layer of alloy from powdered material. In applying adherent material, it protects the powder particles from gross oxidation by using an inert or reducing gas. In addition, it functions as a hot forge to work the particles as they impact. The forged particles are quickly cooled by conduction to the substrate.

The diffusion coating step is basically aluminiding, chromiding or similar type. Thus it adds Al, and preferably Cr or other elements, to the plasma matrix layer by diffusion into the surface and subsequently into the substrate material. Simultaneously, some elements of the substrate material generally diffuse into the coating portion. Also, Cr can be included in the coating from the matrix material, from the filler metal or both. Thus the article produced generally has a coating portion, which may be complex as in the case of the present invention, a diffusion zone and a substrate metallurgically bonded to the coating through the diffusion zone. The diffusion process used in the present invention, conducted through the plasma matrix coating, provides chemical gradients which are important to the matching of properties between the substrate metal and the coating materials. The combination of heat applied during the process and the resulting diffusion through the less-than-fully-dense plasma layer or matrix also consolidates and recrystallizes the structure leaving it ductile and soft.

Figure 1:
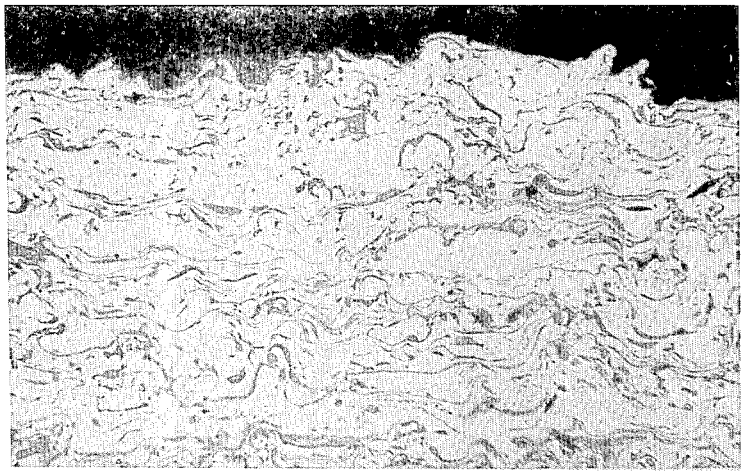
FIG. 1 is a photomicrograph at 500X of the coating matrix as-applied during the method of the present invention.

During the evaluation of the present invention, as an example of the MCr or more specifically the MCrAlY type of alloy, a FeCrAlY alloy was used in powder form of about −325 mesh to develop the fused coating matrix through plasma spraying. The particular alloy powder used in this example consisted nominally of, by weight, 25% Cr, 4% Al, 1% Y with the balance Fe. Used as the metal surface or substrate on which the coating matrix was applied was a nickel base superalloy, sometimes referred to as René 80 alloy, and described in U.S. Pat. No. 3,615,376 - Ross issued Oct. 26, 1971. Prior to plasma spraying, the surface to be coated was grit blasted with 45 grit $Al_2O_3$ at about 80 psi. Then the FeCrAlY alloy powder was plasma sprayed through a mixture of argon and hydrogen gas to reduce oxidation of the heated particles during deposition. Because the present invention is directed toward retention of work in the particle, melting of the particles was avoided in order to propel toward and impinge upon the substrate a heated rather than molten particle in order to enhance retention of deformation in the deposited particle upon cooling through conduction into the substrate. Typical of the structure produced at this point is the hot worked structure in the 500X photomicrograph of FIG. 1 shown in the as-sprayed, unetched condition. Electron probe analysis of such structure showed that there was no significant composition change by spraying. It can be noted from FIG. 1 that certain interparticle oxides are also visible in the structure. However, they did not interfere with the generally good consolidation or forging of the plasma sprayed coating matrix. The matrix was deposited to a thickness of about 4.5 mils.

In the evaluation of the second principal step in the method with which the present invention is concerned, in order to provide a coated article of improved resistance to hot corrosion based in part on improved coating ductility, the above-described plasma sprayed matrix was aluminided. This was conducted to provide on some specimens substantially pure aluminum, which during processing formed an aluminide with and recrystallized the matrix. On other specimens representing one preferred form of the invention, an alloy of aluminum and at least one other element which controls the percent of aluminum in the coating by either changing the solubility of the substrate for Al or forming a stable Al compound, or both, was deposited on the matrix and diffused to alloy such elements with the matrix. It has been found that the element Cr is particularly useful in this respect because of the tendency for Cr and Al mutually to exclude each other. Thus the basis for including a powder of Cr or alloys including Cr along with a powder of Al or alloys including Al in an aluminiding mixture of powders was as a control factor in limiting the Al deposition to lower levels. As was mentioned before, the diffusion coating process concerning the present invention is critical in that it recognizes the difference in the rates at which Al diffuses into the matrix depending on the base element M selected from Fe, Co or Ni. The Al activity with or diffusion into Fe is very high, into Co is very low and into Ni is intermediate to Fe and Co. Thus, as will be shown in the examples, diffusion of Al into an Fe base, even from low concentration sources, must be controlled by elements such as Cr. However, diffusion rates into a Co base are so low that higher concentration of Al must be employed to force the Al into the Co base. In any event, the present invention recognizes that the diffusion step must be sufficiently active to provide in the coating layer an Al content in the average range of about 8 – 20 weight percent Al. It has been found, as will be described in detail later, that concentrations of Al in the coating layer greater than about 20 weight percent resulted in hard, brittle coatings which cracked and became corroded and oxidized during exposure to corrosive and oxidizing conditions. Less than about 8 weight percent Al provides insufficient Al for improvement in corrosion and oxidation resistance.

The particular aluminiding method used in this series of examples is that described in U.S. Pat. No. 3,667,985 - Levine et al, issued June 6, 1972. The source of aluminum in this example was an aluminum-bearing powder of Ti-Al-C alloy in the range of about 50 – 70% Ti, 20 – 48% Al, 0.5 – 9% combined C and more specifically consisting nominally, by weight, of about 5% combined C, about 35% Al with the balance Ti and incidental impurities. This alloy is powdered form of about −100/+325 mesh was mixed with a halide activator in the range of about 0.1 – 10 weight percent, in this case 0.1% $NH_4F$, with the balance of the mixture powdered alumina. $NH_4F$ is typical of the halide salt activators used in the art and which react with an element in the mixture to form a halide of that element. Particularly useful are the halides of the alkali metals including $NH_4F$, $NH_4Cl$, NaF and KF.

In the practice of the present invention in that form using the above-identified Ti-Al-C alloy powder as the source of Al in the mixture including alumina and the halide salt activator, there is recognition of the relative rates of diffusion of Al into an Fe, Co or Ni base matrix. It has been found that the Ti-Al-C alloy powder concentration by weight in the mixture for use with a matrix based on Fe should be about 0.5 – 2%, on Co should be about 4 – 80% and on Ni should be about 2 – 20%.

In one particular series of tests, described in the examples with an Fe base matrix, the amount of powdered Ti-Al-C alloy in the powder mixture was varied between about 1 – 4 weight percent. According to this method for use with such a base, the aluminiding powder mix described above was modified through the addition of powdered Cr to control Al activity. For example, the Cr was included in an amount of about 0.5 weight percent, such as to provide a ratio between that powdered alloy of Al and the Cr powder in the range of about 2:1 – 8:1. In such control of Al activity, Cr can be included in the range of about 0.5 – 4 weight percent.

Elements such as Al or Al and Cr can be applied to the plasma sprayed matrix in a variety of ways to produce a coating layer including about 8 – 20 weight percent Al and, when included, preferably about 20 – 30 weight percent Cr. For example, they can be applied in the pack type process in which the article is immersed in the powder mixture. Alternatively, the article can be suspended away from contact with the mixture as described in U.S. Pat. No. 3,598,638 - Levine issued Aug. 10, 1971. In addition, in a method which will be described in more detail hereinafter, a slurry of the alloying powders can be applied as an interim slurry coat on the surface to be coated. Then, after drying, the coated surface can be subjected, such as by immersion, in a pack of alumina and a halide activator, such as $NH_4F$, to bring about a vapor type deposition on that surface to which the source of alloy in slurry form has been applied.

In one specific series of evaluation tests, specimens of the above-described cast René 80 nickel base superalloy and specimens of a cast cobalt base superalloy, sometimes referred to as X-40 alloy and consisting nominally by weight, of 0.5% C, 25% Cr, 7.5% W, 10.5% Ni with the balance essentially Co and incidental impurities, were plasma sprayed with the above-identified Fe base FeCrAlY alloy to deposit a coating matrix. Then the specimens were diffusion treated by immersing in a pack of the above-described Ti-Al-C alloy-halide activator-alumina mixture includingthe weight percent metal powder or powders shown in the following Table I and heating in a non-oxidizing atmosphere in the range of about 1600° – 2000°F.

TABLE I

| EXAMPLE | Metal Powder (WT% OF MIX) | MATRIX: FeCrAlY Specimen Alloy | REMARKS |
|---|---|---|---|
| 1 | 2 Ti-Al-C | X-40 | Small cracks in diffusion zone (120 hrs.); surface corrosion and internal oxidation (402 hrs.) |
| 2 | 4 Ti-Al-C | X-40 | Cracking throughout coating (72 hrs.); surface corrosion and internal oxidation (402 hrs.) |
| 3 | 4 Ti-Al-C | René 80 | Large cracks (240 hrs.); surface and internal oxidation, corrosion along cracks (402 hrs.) |
| 4 | 1 Ti-Al-C +0.5 Cr | René 80 | No cracking, corrosion or oxidation after 402 hrs. |

Tests conducted on the specimens represented by those in Table I, which includes remarks concerning visual and metallographic examination, included tests in a platinum crucible holding a salt mixture. Such mixture consisted of 80 mole percent $Na_2SO_4$ and 20 mole percent $V_2O_5$, equivalent to 51.1 weight percent $SO_4$ and 13.6 weight percent V. Prior to use, the mixture was aged for 20 hours at 1650°F, the intended test temperature, after which the analysis was 41.7 weight percent $SO_4$ and 14.1 weight percent V due to the loss of $SO_2$ and $SO_3$.

Specimens were immersed in the salt mixture within platinum crucibles for up to about 400 hours at 1650°F in air with about one-fourth inch of uncoated specimen within the salt mixture.

The combination of plasma spraying of the FeCrAlY matrix through which are diffused substantially pure aluminum from the Ti-Al-C alloy enhanced the corrosion and oxidation resistance of the article surface: the life of René 80 alloy the surface of which was treated only with the pack mixture described in connection with example 3 in Table I, without the plasma sprayed matrix, is about 10 – 15 hours. However, as can be seen from the remarks of Table I, cracking, oxidation and corrosion occurred in such coating during the approximately 400-hour test, despite application of the coating combination of al diffused through the FeCrAlY matrix: because of the high activity between Al and the Fe-base matrix, too much Al was provided in the coating. For comparison, when a controlled alloy of aluminum, in the case of example 4 an alloy of aluminum and chromium deposited from separate powders as sources of Cr and of Al, was diffused through the matrix surface in the practice of the present invention, including recrystallization of the matrix, cracking and surface corrosion and oxidation were eliminated.

Figure 2:
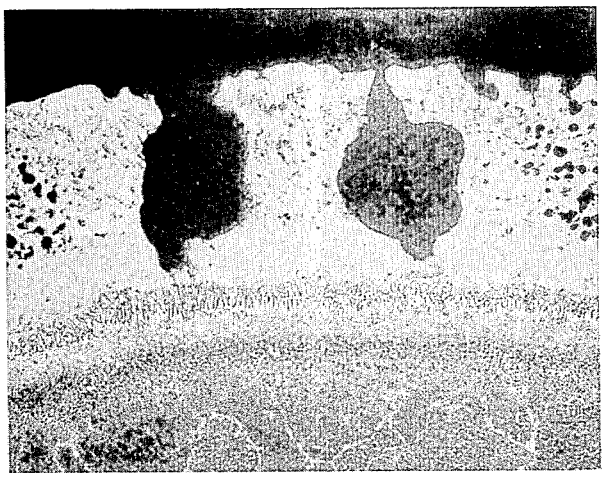
FIG. 2 is a photomicrograph at 250X of the coating matrix diffused with Al after corrosion testing.
Figure 3:
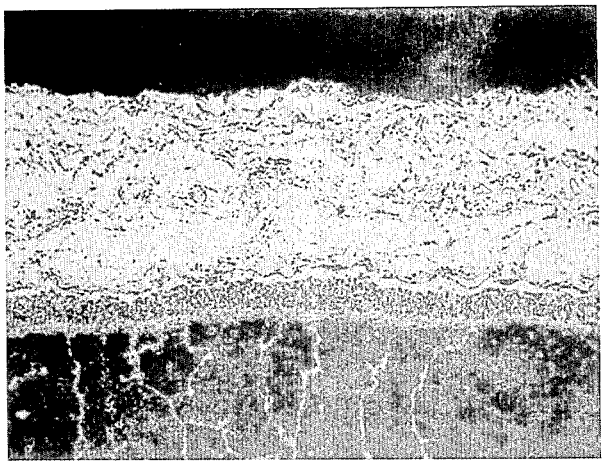
FIG. 3 is a photomicrograph at 250X of the coating matrix diffused with Al and Cr after testing.

A photomicrographic comparison of specimens of examples 3 and 4 in Table I are shown at 250X in FIGS. 2 and 3, respectively. In FIG. 2, the corrosion and oxidation attack after 240 hours is seen on the surface and penetrating through the coating to the diffusion zone. Surface and internal oxidation took place at various localities in the coating. Corrosion occurred along with cracks and resulted in the formation of pockets during the 402-hour test. In contrast, the photomicrograph of FIG. 3 of the coating of the specimen of example 4 in Table I showed no evidence of cracking, corrosion or oxidation of the coating at the completion of the test. Thus, those specimens, the Fe base matrix of which was diffused only with aluminum, had significantly reduced corrosion and oxidation life and lower resistance to thermal cracking than did the coating applied according to the present invention and in which the Al deposition was controlled by an element such as Cr.

Figure 4:
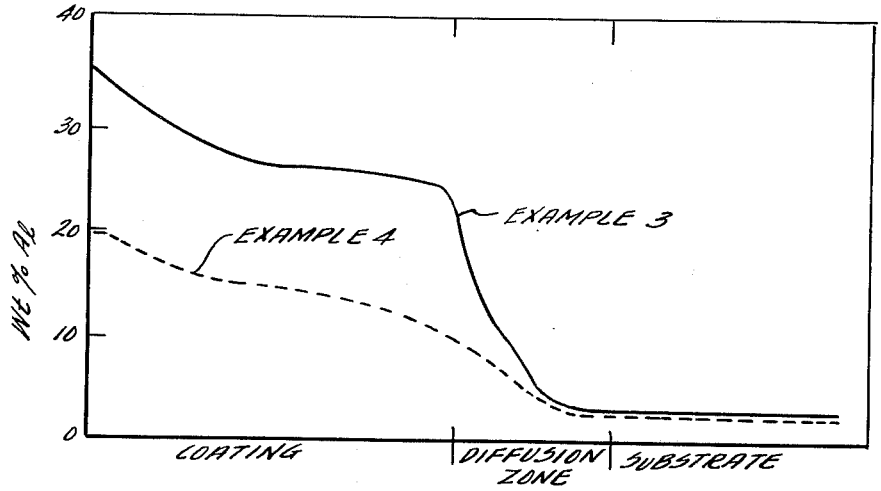
FIG. 4 is a graphical presentation of the Al content in an article coated according to the present invention.
Figure 5:
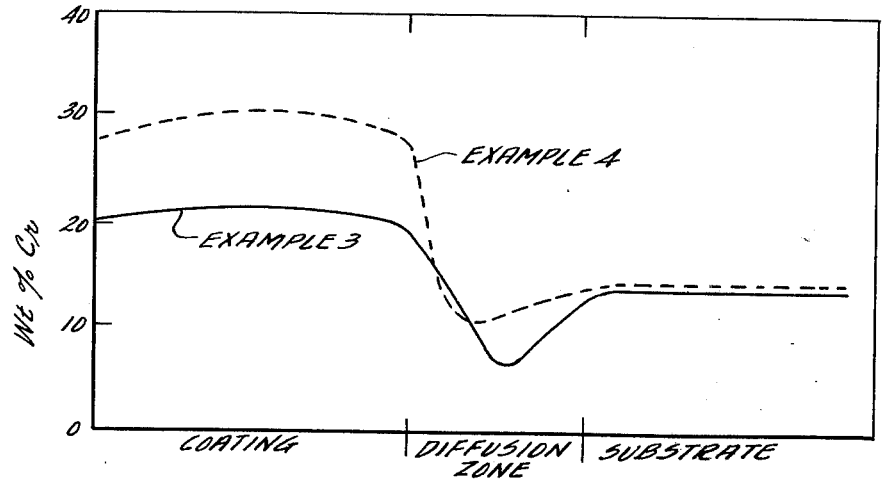
FIG. 5 is a graphical presentation of the Cr content in an article coated according to the present invention.

In a study of the chemical composition of the coating, the diffusion zone and the substrate, it was recognized that when the average aluminum content in the coating was maintained in the range of about 8 – 20 weight percent while the average Cr content in the coating was maintained in the range of about 20 – 30 weight percent, improved coating properties resulted. These data are shown in the graphical presentation of FIGS. 4 and 5 for the concentration of Al and Cr, respectively. If the Al content is below about 8% the coating tends to lose corrosion resistance. Al content above about 20% results in a hard coating which tends to be brittle. If the Cr content is below about 20%, corrosion resistance in the coating is too low, whereas above 30% Cr, the coating becomes hard and brittle and is susceptible to thermal cracking.

In other examples of coating superalloy substrates with MCr base alloys, for example MCrAlY alloys, differences arose due to different diffusion rates of Al in Fe base, Ni base and Co base alloys. As has been discussed, the diffusion rates decrease in the order stated.

Example 5: A plasma sprayed Co base matrix deposited from prealloyed powder consisting nominally of, by weight, 25% Cr, 4% Al, 1% Y with the balance Co, was deposited on specimens of the above-identified X-40 alloy. The matrix was then aluminided using 40 weight percent of the Ti-Al-C alloy in the above-described powder mixture was alumina and halide salt activator. The higher concentration of Al was required, within the broad range of 4 – 80% of the Ti-Al-C alloy, to diffuse the desired amount of Al into the matrix during diffusion and recrystallization. The specimens were subjected to a hot corrosion test by immersion in a mixture of $Na_2SO_4$ and carbon. The test was conducted at 1650°F under an argon atmosphere. Such a non-oxidizing environment is a more aggressive test condition than air. Specimens of X-40 alloy without the CoCrAlY matrix but only coated by aluminiding with the same mixture of powders were exposed as a control reference. Hot corrosion failure occurred on such control specimens in 8 – 10 hours; however, the CoCrAlY-aluminided specimens did not fail until 24 – 47 hours.

Example 6: Articles in the form of hollow gas turbine engine turbine vanes were manufactured from a Ni-base superalloy sometimes referred to as René 77 alloy and consisting nominally by weight of 0.07% C, 14.6% Cr, 3.4% Ti, 0.016% B, 4.3% Al, 15% Co, 4.2% Mo with the balance Ni and incidental impurities. The previously identified Fe-base FeCrAlY alloy was plasma sprayed as a matrix onto the outer surfaces of the vanes. The matrix was then aluminided in a powder pack mixture consisting by weight of 1.2% Ti-Al-C alloy powder, 0.7% Cr powder, with the balance alumina and $NH_4F$ activator in the range of 1800° – 1900°F for about 4 hours in hydrogen. Concurrently, the hollow interior, which did not include the matrix, was aluminided by placing within the interior a pack mixture including 2 weight percent Ti-Al-C alloy along with the alumina and activator. After treatment, the outer coating included, by weight, an average of 15% Al and 25% Cr, while the interior coating of NiAl ranged from 25% Al at the surface to 10% Al at the diffusion zone.

Example 7: Specimens of the above-identified René 80 alloy were plasma sprayed with MCr alloy in the form of, by weight, 80% Ni and 20% Cr to provide a matrix on an outer surface. The NiCr matrix was then aluminided and recrystallized at 2000°F for 4 hours in a powder pack including, by weight, 0.7% powdered $FeAl_3$ along with 0.2% $NH_4F$ activator and alumina powder. The $FeAl_3$ alloy used in this example is typical of binary alloys of Al and Fe, Co or Ni which can be used as a source of Al in the aluminiding step. Because of the relatively high activity of such a binary alloy of Fe and Al, a much smaller amount was required as an Al source to provide in the coating an average amount of Al in the average range of about 8 – 20 weight percent. As has been pointed out, larger amounts of Al tend to embrittle the coating. The corrosion life of these specimens, after the above-described crucible test, was three times the life of the same René 80 base alloy the surface of which had only been aluminided.

Example 8: As was mentioned before, one method of aluminiding the matrix coating, applied such as by plasma spraying, is through the application to the matrix surface of a slurry of the powders providing the source of elements to be diffused through the matrix. In this example, subsequent to coating of desired surfaces of a René 80 turbine blade with the above-identified FeCrAlY alloy by plasma spraying, a slurry was made of one part by weight of the Ti-Al-C powder and one part by weight of an inert powder non-reactive in the process, for example, $Al_2O_3$ powder, mixed with a binder solution, for example a plastic material such as an acrylic resin which decomposes upon heating with substantially no undesirable residue. The slurry was applied as a coating to the plasma sprayed areas in an ordinary manner, for example by spray painting type techniques. After drying, the surface thus treated was subjected to a halide salt activator, in this example by packing in an $Al_2O_3$ powder mixture including 0.5 weight percent $NH_4F$ as the halide activator. After treatment in hydrogen at about 1825°F, the desirable increase in the aluminum content of the coating layer was found. In this example, the aluminum concentration in the coating was increased to about 10 – 18 weight percent.

Example 9: In other example as in example 8, the above-described metal powder, used as a source of aluminum, was replaced by a binary alloy of Ni and Al, for example $Ni_2Al_3$, with comparable results in respect to the increase in aluminum content.

Example 10: One aspect of the method of the present invention is its capability of treating the coating matrix to form the coating layer, while at the same time applying a coating to internal surfaces of hollow articles. An example of such a use is represented by practice of the present method on the above-identified X-40 cobalt base alloy substrate in the form of a hollow turbine vane. The above-identified FeCrAlY powder was applied as a coating matrix on exterior surfaces of the vane by plasma spraying. The vane was then aluminided in one step on the interior and through the matrix on the exterior. To achieve this, a high activity aluminiding pack mixture, for example 80 weight percent Ti-Al-C alloy previously described, with the balance alumina and halide salt activator was placed within the vane interior for treatment of the Co-base substrate. The exterior was packed in a similar mixture but with 2 weight percent of the alloy for treatment of the Fe-Base matrix. Both mixtures included a $NH_4F$ salt activator. Carrying out the above-described aluminiding reaction in hydrogen produced excellent protective coatings on the inside as well as on the exterior of the vane.

The elemental gradients in the coating-diffusion zone-substrate composite are a direct result of the diffusion process. Their character is displayed in FIG. 6 which graphically shows a typical microprobe trace of Al, Cr and Ni in an Fe-base coating on a René 80 Ni-base superalloy substrate. The gradual variation in composition is believed to result in properties gradually changing with depth and providing a smooth accommodation between the surface layers and the substrate.

The coating chemistry influences corrosion properties. In a corrosion test using a burner fired with JP5 jet fuel in a 30:1 air/fuel ratio and ingestion of 5 ppm sea salt, a comparison of an aluminided FeCrAlY coating was made on a nickel base superalloy substrate. The coating showed a first sign of corrosion at 1200 hours compared to 395 hours average for the surface only aluminided.

One of the features of the present invention is that the recrystallized coating is ductile as well as resistant to oxidation and hot corrosion. Its ductility allows it to resist cracking during thermal cycling. It has been recognized that in order to maintain such ductility, the average room temperature hardness of the coating layer, not including the diffusion zone, must be less than about 500 Diamond Pyramid Hardness (Vickers, DPH). Data of the following Table II shows a comparison of such hardness traversing inwardly through the coating, the diffusion zone and into the substrate.

TABLE II

| Example | Metal Powder (wt.% of Mix) | Specimen Alloy | Hardness (Vickers DPH) Coating 1 | Coating 2 | Diffusion | Substrate 1 | Substrate 2 |
|---|---|---|---|---|---|---|---|
| 11 | 2 Ti-Al-C | René 80 | 503 | 548 | 642 | 409 | 345 |
| 12 | 1 Ti-Al-C +0.5 Cr | René 80 | 441 | 454 | 612 | 473 | 433 |

Figure 6:
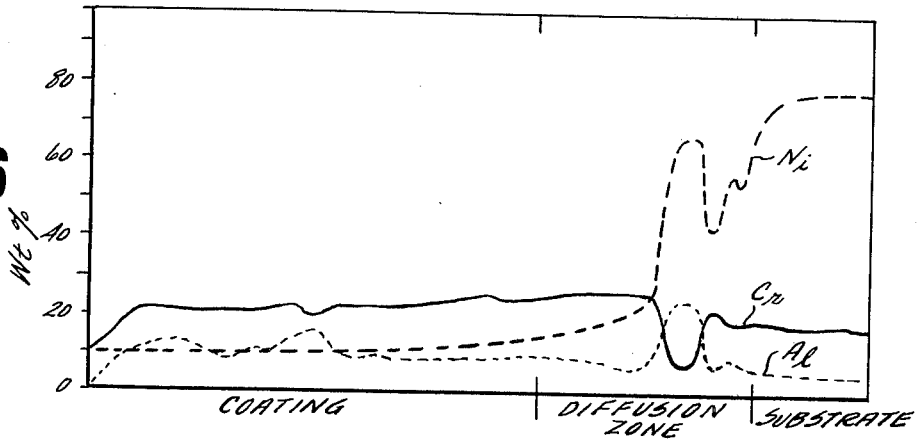
FIG. 6 is a graphical presentation of a microprobe trace of Al, Cr and Ni in an Fe-base matrix on a Ni-base superalloy; interdiffused

The specimen of example 11 was similar to that of example 1 in Table I and was subject to corrosion, oxidation and cracking. The specimen of example 12, the same as that of example 4 in Table I and the specimen traced in FIG. 6, showed no cracking, corrosion or oxidation during the test. Thus the average hardness of the coating is important to its resistance to thermal cracking.

Figure 7:
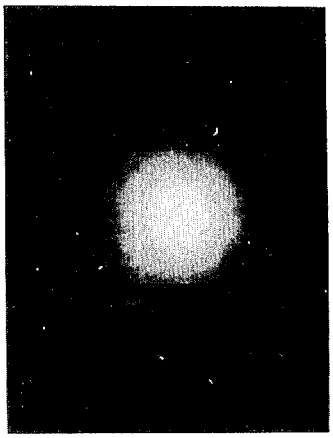
FIG. 7 is a photograph of an X-ray diffraction pattern from an FeCrAlY matrix as applied by plasma spray techniques.
Figure 8:
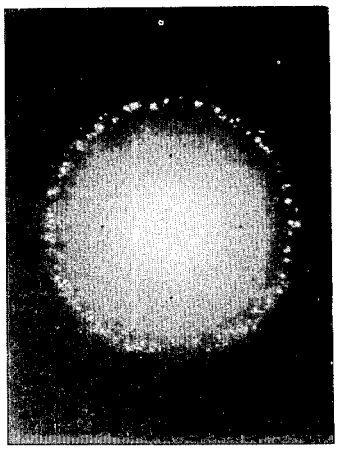
FIG. 8 is a photograph of an X-ray diffraction pattern of the recrystallized matrix of FIG. 7 after application of the filler metal to the matrix.

That the coating is recrystallized as a result of applying the filler metal is shown in FIGS. 7 and 8. FIG. 7 is an X-ray diffraction pattern from an FeCrAlY matrix applied and worked by the hot forging, plasma spray technique. The rings are diffuse indicating deformation is retained in the matrix. FIG. 8 shows that after application of the filler to the matrix as described previously, the coating recrystallizes as evidenced by the spotty diffraction ring. This recrystallization which is important to the good mechanical behavior of the coating, according to the present invention, is not achievable through such deposition processes as physical vapor deposition or slurry-applied methods in which deformation is not introduced in the matrix.

The combination and methods of the present invention thus provide not only reistance to corrosion and oxidation but also resistance to failure such as cracking which can result from thermal cycling during operation. it It be understood by those skilled in the art that the present invention is capable of variation and modification within its broad scope presented here. It is intended to cover such scope in the appended claims.

What is claimed is:

1. A coated article of improved resistance to hot corrosion comprising:

a substrate of an alloy based on an element selected from the group consisting of Fe, Co and Ni; and a coating comprising a deformed and predominately recrystallized coating layer metallurgically bonded by interdiffusion with the substrate, the coating comprising:

a. a matrix of a plurality of fused and forged particles of an alloy based on an element (M) selected from the group consisting of Fe, Co and Ni, and b. a filler of a metal selected from the group consisting of Al and alloys including Al interdiffused with the matrix, the coating including an average of about 8 – 20 weight percent Al, with the balance elements of the alloy of M and elements of the substrate, and having a hardness of no more than about 500 Vickers DPH.

2. The article of claim 1 in which:

the matrix particles comprise an MCr-base alloy;

the filler is an alloy including Al and Cr;

the coating includes an average Cr content in the range of about 20 – 30 weight percent.

3. The article of claim 2 in which the MCr-base alloy consists essentially of, by weight, 15 – 50% Cr, 3 – 25% Al, up to about 5% of a material selected from the group consisting of Y and rare earth elements, with the balance an element selected from the group consisting of Fe, Co and Ni.

4. The article of claim 2 in which there is dispersed in the MCr-base alloy, particles of a non-metallic material selected from the group consisting of oxides and compounds of Al, Cr, Y, the rare earth elements or their combinations.

* * * * *